US011408117B2

(12) United States Patent
Song et al.

(10) Patent No.: US 11,408,117 B2
(45) Date of Patent: Aug. 9, 2022

(54) LAUNDRY TREATMENT APPARATUS

(71) Applicant: LG ELECTRONICS INC., Seoul (KR)

(72) Inventors: Sungho Song, Seoul (KR); Minji Kim, Seoul (KR); Sungmin Ye, Seoul (KR); Jongseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 77 days.

(21) Appl. No.: 16/402,647

(22) Filed: May 3, 2019

(65) Prior Publication Data

US 2019/0257026 A1 Aug. 22, 2019

Related U.S. Application Data

(62) Division of application No. 14/991,296, filed on Jan. 8, 2016, now abandoned.

(30) Foreign Application Priority Data

Jan. 9, 2015 (KR) ..... 10-2015-0003312
Jan. 9, 2015 (KR) ..... 10-2015-0003313

(51) Int. Cl.
*D06F 73/00* (2006.01)
*D06F 59/02* (2006.01)

(52) U.S. Cl.
CPC ..... *D06F 73/00* (2013.01); *D06F 59/02* (2013.01)

(58) Field of Classification Search
CPC ..... D06F 57/00; D06F 59/02; D06F 73/00; D06C 3/08; D06C 5/005; A47G 25/14; A47G 25/20; A47G 25/24; A47G 25/26; A47G 25/28; A47G 25/48; A47G 25/62
USPC ..... 38/102
See application file for complete search history.

(56) References Cited

U.S. PATENT DOCUMENTS

| | | | | |
|---|---|---|---|---|
| 2,998,903 | A * | 9/1961 | Day | A47G 25/14 223/68 |
| 3,184,127 | A | 5/1965 | Smith | D06F 59/02 223/67 |
| 3,790,043 | A * | 2/1974 | Hagen | A47G 25/62 223/61 |
| 8,028,868 | B2 * | 10/2011 | Mangano | A47G 25/62 223/85 |
| 2008/0035683 | A1 | 2/2008 | Wynn | |
| 2011/0203130 | A1 | 8/2011 | Date | D06F 58/203 34/565 |

(Continued)

FOREIGN PATENT DOCUMENTS

| | | | |
|---|---|---|---|
| CN | 2220488 | Y | 2/1996 |
| CN | 2405953 | Y | 11/2000 |
| CN | 2463431 | Y | 12/2001 |
| CN | 2714598 | Y | 8/2005 |
| DE | 4103903 | A1 | 9/1991 |

(Continued)

OTHER PUBLICATIONS

KR20090070451—Machine Translation (Year: 2009).
KR101302170—Machine Translation (Year: 2012).

*Primary Examiner* — Marc Lorenzi
(74) *Attorney, Agent, or Firm* — Dentons US LLP

(57) ABSTRACT

A laundry treatment apparatus including a support body for supporting laundry, an air supply unit for supplying air into laundry hung on the support body, and a tensile force provision unit for providing a tensile force to the laundry hung on the support body.

14 Claims, 12 Drawing Sheets

(56) References Cited

U.S. PATENT DOCUMENTS

| | | | | |
|---|---|---|---|---|
| 2013/0097896 | A1 | 4/2013 | Moon | D06F 58/10 38/102 |
| 2016/0108576 | A1 | 4/2016 | Levy | D06F 59/02 223/85 |
| 2017/0342650 | A1* | 11/2017 | Mainini | A47G 25/622 |

FOREIGN PATENT DOCUMENTS

| | | | | |
|---|---|---|---|---|
| DE | 19629895 | C1 | 3/1998 | |
| DE | 20218564 | U1 | 4/2003 | |
| EP | 1946683 | A2 | 7/2008 | |
| EP | 2397603 | A1 | 12/2011 | |
| GB | 602083 | A * | 5/1948 | A47G 25/325 |
| GB | 2094840 | A | 9/1982 | |
| JP | 7-124393 | A | 5/1995 | |
| JP | 7-44300 | U | 11/1995 | |
| JP | 10-230100 | A | 9/1998 | |
| JP | 2002-238727 | A | 8/2002 | |
| JP | 3092154 | U | 12/2002 | |
| KR | 10-1998-076136 | A | 11/1998 | |
| KR | 20-0354714 | Y1 | 6/2004 | |
| KR | 10-2009-0070451 | A | 7/2009 | |
| KR | 20-2010-0002172 | U | 3/2010 | |
| KR | 20-0450902 | Y1 | 11/2010 | |
| KR | 10-2011-0035030 | A | 4/2011 | |
| KR | 10-2012-0123923 | A | 11/2012 | |
| KR | 101302170 | B1 | 8/2013 | |
| KR | 10-2014-0031544 | A | 3/2014 | |
| WO | 99/49123 | A1 | 9/1999 | |
| WO | 02/052096 | A1 | 7/2002 | |
| WO | 2007/067777 | A2 | 6/2007 | |

* cited by examiner

LAUNDRY TREATMENT APPARATUS

This application is a Divisional of U.S. patent application Ser. No. 14/991,296, filed on Jan. 8, 2016, which claims the benefit of Korean Patent Application Nos. 10-2015-0003313 and 10-2015-0003312, both filed on Jan. 9, 2015, each of which is hereby incorporated by reference for all purposes as if fully set forth herein.

BACKGROUND

Field

The present disclosure relates to a laundry treatment apparatus.

Discussion of the Related Art

Generally, a laundry treatment apparatus is an apparatus that performs various kinds of operations (e.g., washing, drying, and deodorization) related to laundry. The laundry treatment apparatus includes a washer for washing laundry, a dryer for drying wet laundry, and a refresher for deodorizing laundry.

In recent years, combination type laundry treatment apparatuses for washing, drying, and deodorizing laundry have been developed. However, such laundry treatment apparatuses cannot effectively remove wrinkles from laundry since the laundry treatment apparatuses include a drum for receiving laundry and a driving device for rotating the drum.

That is, in the conventional laundry treatment apparatus, laundry placed in the drum is rotated together with the drum without being straightened, with the result that the laundry remains wrinkled in the drum. For this reason, the conventional laundry treatment apparatus cannot completely remove wrinkles from laundry.

SUMMARY

Accordingly, the present disclosure is directed to a laundry treatment apparatus that substantially obviates one or more problems due to the limitations and disadvantages of the related art.

One object is to provide a laundry treatment apparatus that is capable of removing wrinkles from laundry after the laundry is washed, dried, or worn.

Additional advantages, objects, and features will be set forth in part in the description which follows and in part will become apparent to those having ordinary skill in the art upon examination of the following or may be learned from practice of the invention. The objectives and other advantages may be realized and attained by the structure particularly pointed out in the written description and claims hereof as well as the appended drawings.

To achieve these objects and other advantages and in accordance with the purpose of the invention, as embodied and broadly described herein, a laundry treatment apparatus includes a support body for supporting laundry, an air supply unit for supplying air into laundry hung on the support body, and a tensile force provision unit for providing a tensile force to the laundry hung on the support body.

The tensile force provision unit may be separably connected to the support body.

The laundry treatment apparatus may further include an expansion and contraction part connected between the tensile force provision unit and the support body for adjusting the distance between the tensile force provision unit and the support body.

The tensile force provision unit may be separably connected to the laundry hung on the support body.

The tensile force provision unit may be provided in a manner that enables at least some of the air supplied into the laundry to flow back toward the air supply unit.

The tensile force provision unit may include a tensile force provision body for separating inner circumferential surface parts of the laundry from each other such that the inner circumferential surface parts of the laundry are spaced apart from each other by a predetermined distance and a fixing part separably attached to the laundry for connecting the tensile force provision body to the laundry.

The laundry treatment apparatus may further include an attachment and detachment part for separably coupling the tensile force provision body to the support body.

The attachment and detachment part may include a first attachment and detachment part provided at one selected from between the support body and the tensile force provision body and a second attachment and detachment part provided at the other selected from between the support body and the tensile force provision body such that the second attachment and detachment part is configured to couple the first attachment and detachment part.

The laundry treatment apparatus may further include an inlet port provided in the support body such that the air supply unit is coupled to the inlet port, a first discharge port provided in the support body for allowing air introduced through the inlet port to be discharged therethrough toward the tensile force provision body, and a second discharge port and a third discharge port provided in the support body for allowing the air introduced through the inlet port to be discharged therethrough toward respective sleeves of the laundry.

The laundry treatment apparatus may further include a guide body located under the inlet port, a through hole formed through the guide body for guiding the air introduced through the inlet port to the first discharge port, a first inclined surface provided on the guide body for guiding the air introduced through the inlet port to the second discharge port, and a second inclined surface provided on the guide body for guiding the air introduced through the inlet port to the third discharge port.

The tensile force provision unit may include a tensile force provision body for separating the inner circumferential surface parts of the laundry from each other such that the inner circumferential surface parts of the laundry arc spaced apart from each other by a predetermined distance, a tensile force provision body receiving part separably connected to the support body for receiving the tensile force provision body, and a fixing part separably attached to the laundry for connecting the tensile force provision body receiving part to the laundry.

The tensile force provision unit may further include an extension part provided at the tensile force provision body such that the extension part can be withdrawn from the tensile force provision body.

The attachment and detachment part may include a first attachment and detachment part provided at one selected from between the support body and the tensile force provision body receiving part and a second attachment and detachment part provided at the other selected from between the support body and the tensile force provision body receiving part such that the second attachment and detachment part is configured to couple the first attachment and detachment part.

The laundry treatment apparatus may further include a receiving recess provided in the tensile force provision body receiving part for adjusting the distance between the tensile force provision body and the support body.

The fixing part may include a first fixing member and a second fixing member provided at opposite surfaces of the tensile force provision body receiving part for fixing the laundry to the tensile force provision body receiving part.

The laundry treatment apparatus may further include a fastening unit for separably fixing the support unit to an external structure.

The laundry treatment apparatus may further include a power supply unit provided at the support body for supplying electric power to the air supply unit.

The tensile force provision unit may include a tensile force provision body for separating inner circumferential surface parts of the laundry from each other such that the inner circumferential surface parts of the laundry are spaced apart from each other by a predetermined distance, a tensile force provision body receiving part separably connected to the support body for receiving the tensile force provision body, and a fixing part separably attached to the laundry for connecting the tensile force provision body receiving part to the laundry.

The tensile force provision unit may further include an extension part provided at the tensile force provision body such that the extension part can be withdrawn from the tensile force provision body.

The attachment and detachment part may include a first attachment and detachment part provided at one selected from between the support body and the tensile force provision body receiving part and a second attachment and detachment part provided at the other selected from between the support body and the tensile force provision body receiving part such that the second attachment and detachment part is coupled to the first attachment and detachment part.

The tensile force provision unit may include a tensile force provision body separably connected to the support body and an expansion part for connecting the tensile force provision body to the support body, the expansion part being configured such that the volume of the expansion part is increased by air supplied from the air supply unit when the air supply unit is operated.

The expansion part may include a first expansion body for connecting the tensile force provision body to the support body, the first expansion body being configured such that the volume of the first expansion body is increased when air is supplied from the air supply unit, and a second expansion body and a third expansion body connected to the first expansion body such that the volumes of the second expansion body and the third expansion body are increased, the second expansion body and the third expansion body being inserted into respective sleeves of the laundry.

At least one selected from between the second expansion body and the third expansion body may have a higher rate of expansion than the first expansion body.

The laundry treatment apparatus may further include an inlet port formed through the support body for allowing the inside of the expansion part and the outside of the support body to communicate with each other therethrough, wherein the air supply unit may be provided in the inlet port.

The laundry treatment apparatus may further include a connection part for separably coupling the tensile force provision body to the support body.

The laundry treatment apparatus may further include a receiving recess for receiving the expansion part in a state in which the volume of the expansion part does not increase.

The connection part may include a flange provided along the outer circumferential surface of the upper end of the receiving recess for receiving the outer circumferential surface of the support body.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principles of the invention. In the drawings.

DETAILED DESCRIPTION

Reference will now be made in detail to the preferred embodiments of the present invention, examples of which arc illustrated in the accompanying drawings. It should be noted herein that the construction of an apparatus, which will hereinafter be described, and a control method of the apparatus are given only for illustrative purposes and the protection scope of the invention is not limited thereto. Wherever possible, the same reference numbers will be used throughout the drawings to refer to the same or like parts.

Figure 1:
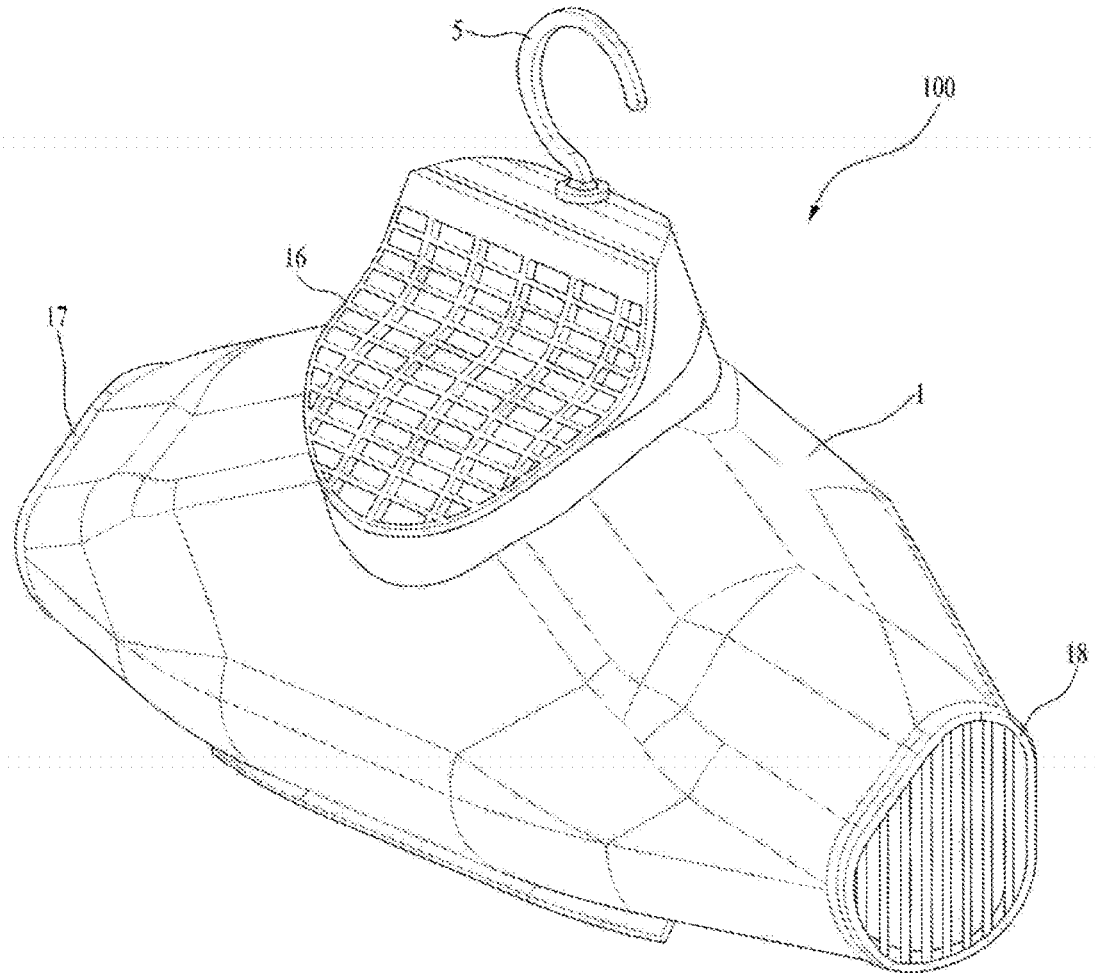
FIGS. 1 and 2 are views showing a laundry treatment apparatus according to an embodiment of the present invention.

As shown in FIG. 1, a laundry treatment apparatus 100 according to an embodiment of the present invention may include a support unit 1 for supporting laundry, an air supply unit 3 provided in support unit 1 for supplying air into the laundry, and a fastening unit 5 for separably fixing support unit 1 to an external structure.

Figure 2:
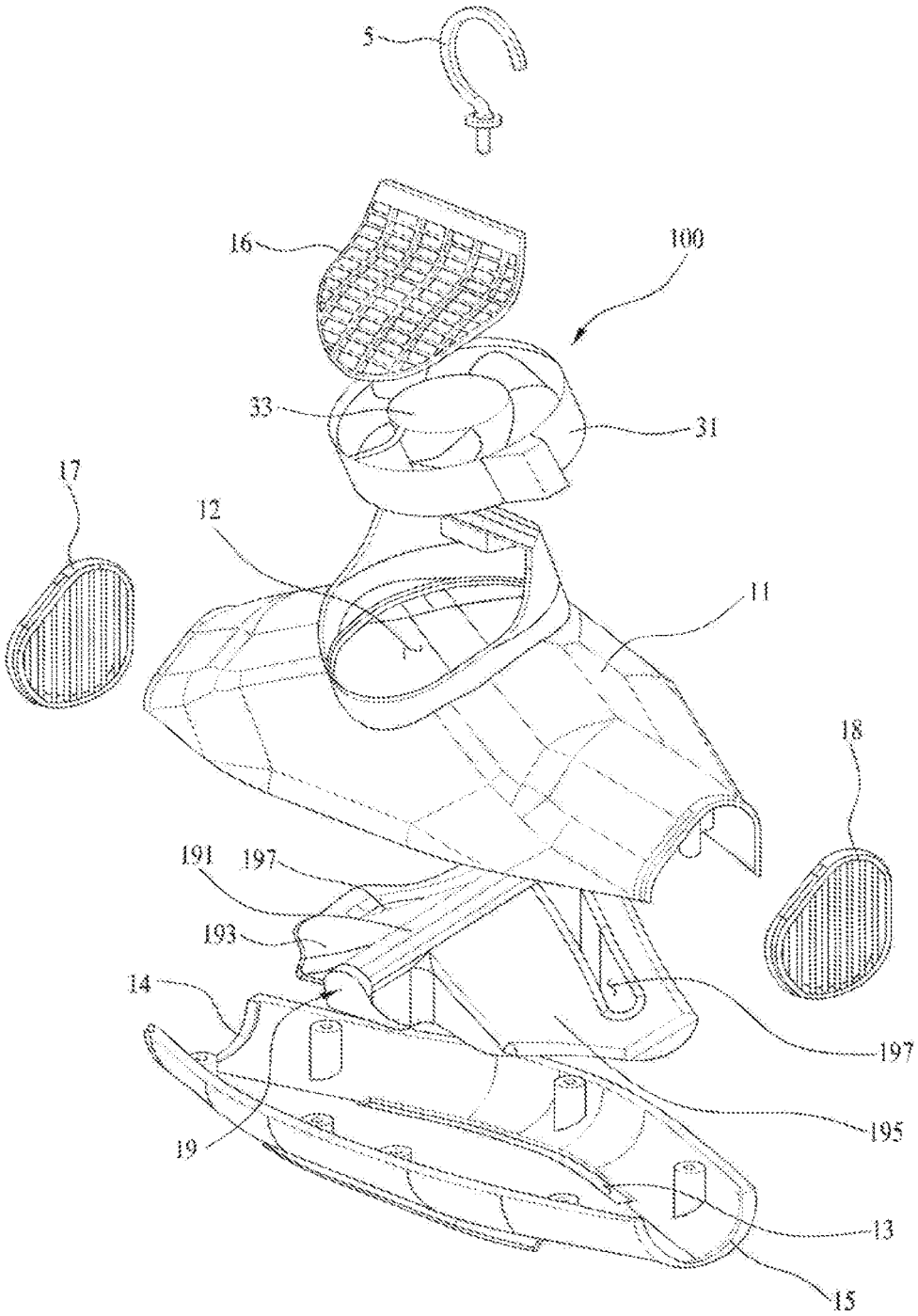

As shown in FIG. 2, support unit 1 may include a support body 11 for supporting laundry, support body 11 having an air flow channel defined therein, an inlet port 12, through which air is introduced into the air flow channel, and a first discharge port 13, through which air in the air flow channel is discharged out of support body 11.

Air supply unit 3, which supplies air into support body 11, may be provided in inlet port 12. Air supply unit 3 may include a housing 31 provided in inlet port 12, a fan 33 rotatably provided in housing 31, and a motor (not shown) for rotating fan 33.

A power supply unit (not shown) may supply electric power to air supply unit 3. The power supply unit may be provided outside support unit 1. Alternatively, the power supply unit may be provided inside support unit 1.

If the power supply unit is provided outside support unit 1, the power supply unit may include a power source provided outside support unit 1 and an electric power cable for connecting the motor (not shown) to the power source.

If the power supply unit is provided inside support unit 1, the power supply unit may be configured as follows.

For example, the power supply unit may be a battery separably disposed in support body 11 for supplying electric power to the motor. In another example, the power supply unit may include a rechargeable battery fixed in support body 11 for supplying electric power to the motor and an electric power cable separably disposed in support body 11 for connecting the rechargeable battery to a power source located outside support body 11 (such that electric power is supplied to the rechargeable battery through the electric power cable).

When air supply unit 3 is operated, external air is supplied into laundry through inlet port 12 and first discharge port 13. The air, supplied into the laundry, flows through the laundry, or is discharged from the laundry through the sleeves of the laundry or an opening formed in the lower end of the laundry. Consequently, air supply unit 3 may be a means for allowing air to flow from inside the laundry to outside the laundry such that wrinkles are prevented from being formed on the laundry (i.e., a means for providing tensile force to the laundry).

The supply of air into the laundry by air supply unit 3 is such that the air supplied by air supply unit 3 is not introduced into the laundry from outside the laundry, but is discharged from inside the laundry to outside the laundry.

Laundry treatment apparatus 100 according to the embodiment of the present invention may be configured to also supply air to sleeves of the laundry. To this end, a second discharge port 14 and a third discharge port 15 for supplying air to respective sleeves of the laundry may be further provided in support body 11.

In a case in which second discharge port 14 and a third discharge port 15 are provided at opposite ends of support body 11, a guide 19 for guiding air to respective discharge ports 13, 14, and 15 may be further provided in support body 11.

Guide 19 may include a guide body 191 provided in support body 11 such that guide body 191 is located under inlet port 12, a through hole 197 formed through guide body 191, and a first inclined surface 193 and a second inclined surface 195 provided at the outer circumferential surface of guide body 191.

With this guide 19, some of the air introduced through inlet port 12 is supplied to first discharge port 13 through the through hole 197, some of the air introduced through inlet port 12 and then guided along first inclined surface 193 is supplied to second discharge port 14, and some of the air introduced through inlet port 12 and then guided along second inclined surface 195 is supplied to third discharge port 15.

Meanwhile, a first filter 16 may be provided in inlet port 12 in order to prevent foreign matter from being supplied to the laundry and, more specifically, to prevent foreign matter from being supplied to fan 33.

A second filter 17 may be further provided in second discharge port 14 and a third filter 18 may be further provided in third discharge port 15 in order to further prevent foreign matter from being supplied to the laundry.

Laundry treatment apparatus 100 with the above-stated structure is operated as follows. After wet laundry (e.g., washed laundry) is hung on support body 11 air supply unit 3 is operated, and the laundry is dried by air supplied into the laundry. In addition, the laundry is unfolded by the air supplied from air supply unit 3, thereby preventing wrinkles from being formed on the laundry.

That is, embodiments of the present invention have the effect of drying the laundry without wrinkles being formed on the laundry, eliminating the need to iron the dried laundry.

The laundry treatment apparatus is also useful for removing wrinkles from laundry that is not wet or laundry that has been worn at least once. That is, laundry that has been dried or laundry that has been worn at least once may be hung on support body 11, water may be sprayed on the laundry using a sprayer, and air supply unit 3 may be operated, by which the same effect as that described above may be achieved.

Fastening unit 5 is a means for fixing support unit 1 to an external structure, such as a wardrobe or a wall. As shown, fastening unit 5 may be configured as a hook.

Figure 3:
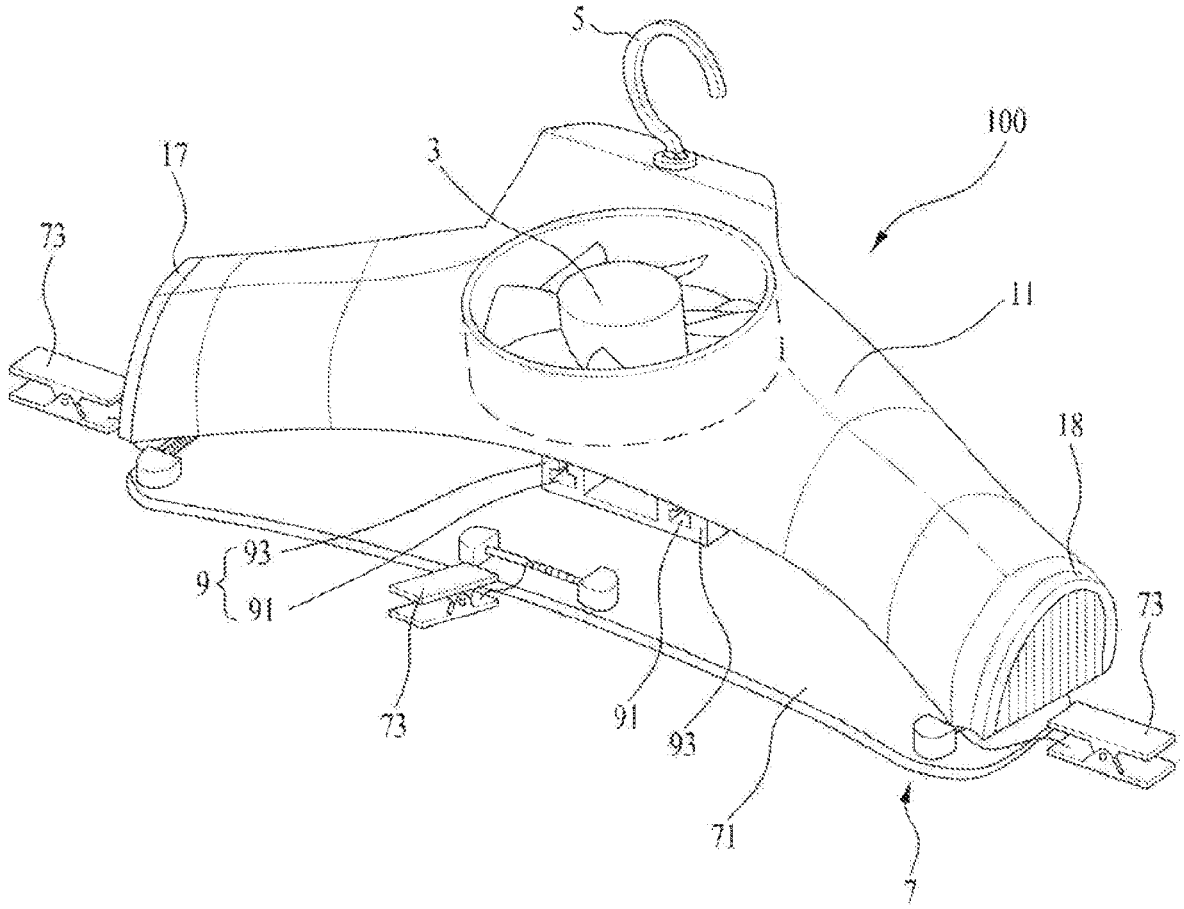
FIGS. 3 to 5 are views showing a laundry treatment apparatus according to another embodiment of the present invention.

FIG. 3 is a view showing a laundry treatment apparatus according to another embodiment of the present invention. Laundry treatment apparatus 100 according to this embodiment is characterized by further including a tensile force provision unit 7 separably fixed to the lower end of laundry for providing tensile force to the laundry.

That is, laundry treatment apparatus 100 according to this embodiment may include a support unit 1 for supporting laundry, an air supply unit 3 provided in support unit 1 for supplying air into the laundry, a fastening unit 5 for separably fixing support unit 1 to an external structure, and a tensile force provision unit 7 separably mounted to support unit 1 such that tensile force provision unit 7 can be fixed to the laundry when tensile force provision unit 7 is separated from support unit 1.

Figure 4:
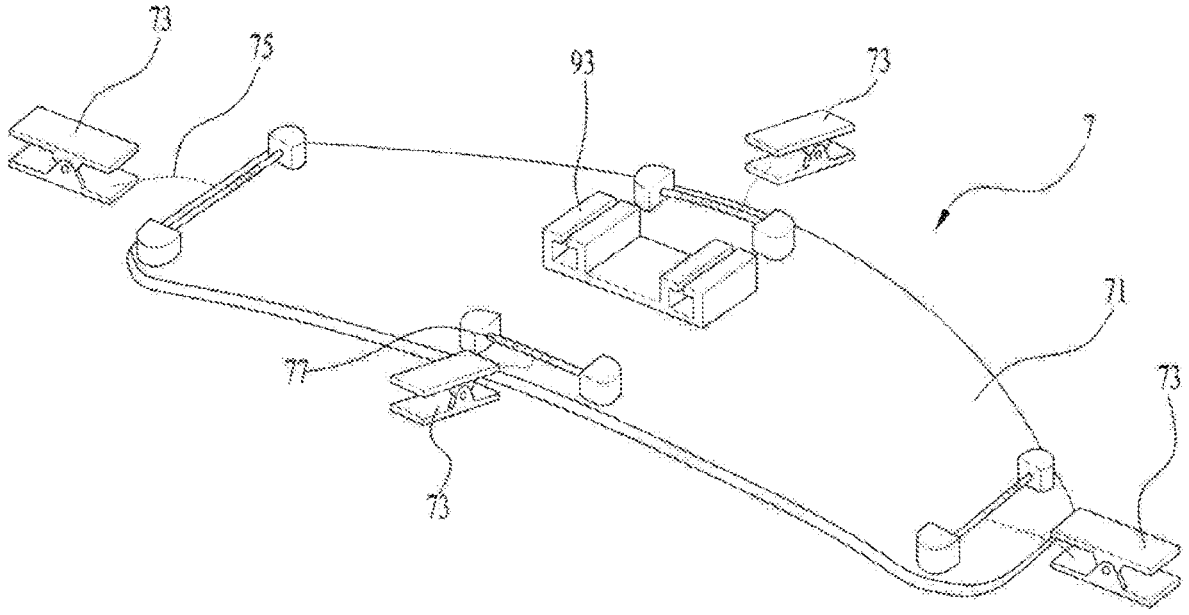

As shown in FIG. 4, tensile force provision unit 7 may include a tensile force provision body 71 disposed inside the laundry for preventing the inner circumferential surface parts of the laundry from contacting each other and a fixing part 73 for fixing tensile force provision body 71 to the laundry.

Tensile force provision body 71 is a means for allowing at least some of the air supplied into the laundry to remain in the laundry so as to provide tensile force to the laundry.

That is, tensile force provision body 71 is a means for reflecting at least some of the air supplied from air supply unit 3 such that the reflected air flows back toward air supply unit 3. To this end, tensile force provision body 71 may be formed to have a board shape that is capable of closing at least a portion of the opening formed in the lower end of the laundry.

Fixing part 73 may be connected to tensile force provision body 71 via a connection part 75. Alternatively, fixing part 73 may be directly fixed to tensile force provision body 71 without any additional member, such as a wire.

Connection part 75 may be a wire having high elasticity (e.g., a wire made of rubber) or a wire having low elasticity.

If connection part 75 is a wire having low elasticity, tensile force provision body 71 may be further provided with a length adjustment part 77 for adjusting the distance between fixing part 73 and tensile force provision body 71.

Figure 5:
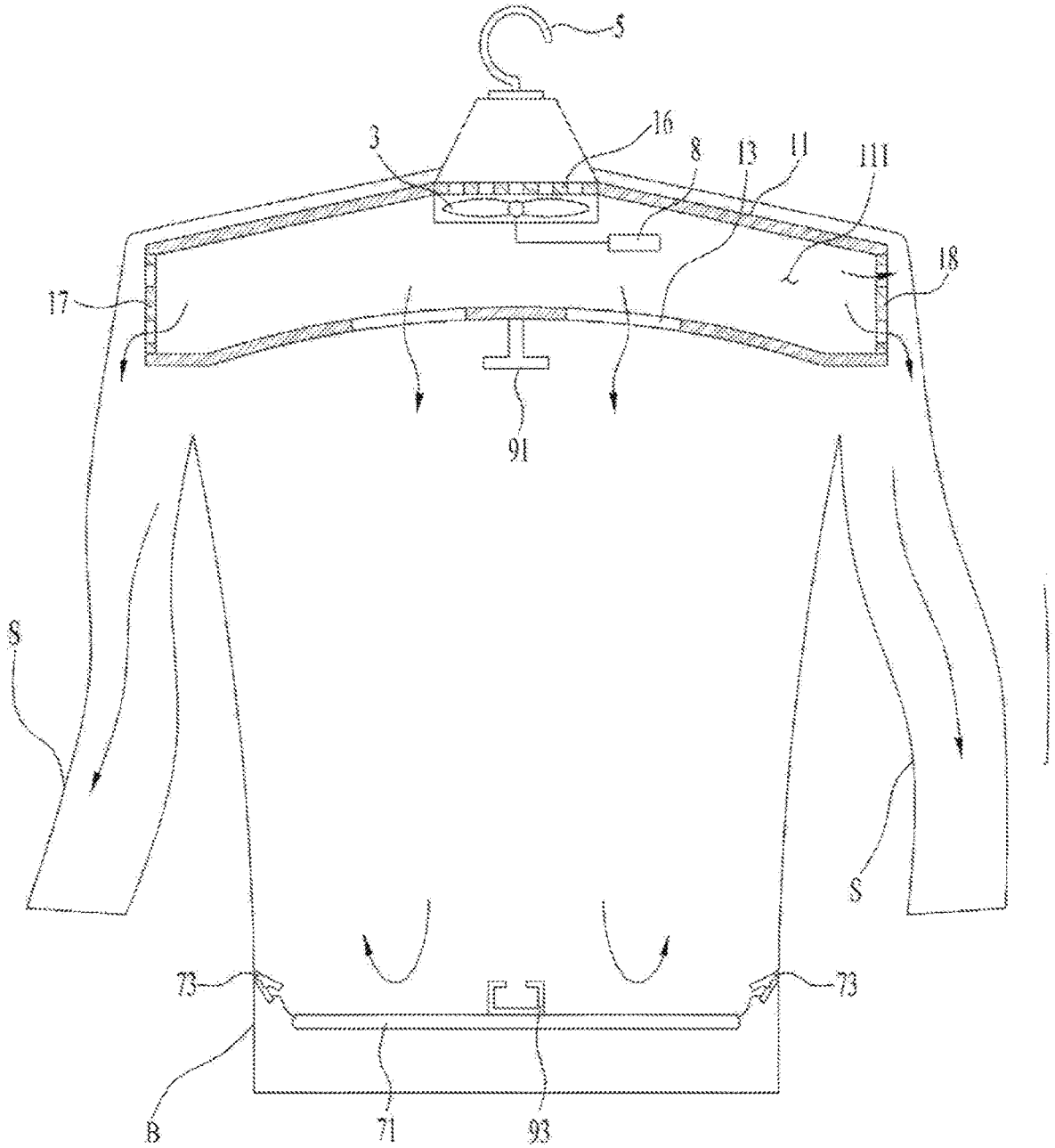

As shown in FIGS. 3 and 5, tensile force provision body 71 may be attached to or detached from support body 11 through an attachment and detachment part 9. Attachment and detachment part 9 may include a first attachment and detachment part 91 provided at one selected from between support body 11 and tensile force provision body 71 and a second attachment and detachment part 93 provided at the other selected from between support body 11 and tensile force provision body 71 such that second attachment and detachment part 93 is coupled to first attachment and detachment part 91. Additionally, attachment and detachment part 9 may further include a wire (not shown) for connecting tensile force provision body 71 to support body 11.

Unlike what is described above, tensile force provision body 71 may be connected to support body 11 via an expansion and contraction part (not shown). In this case, the expansion and contraction part may be a wire the length of which is adjustable or a member having a structure the length of which is adjustable.

As a result, the distance between tensile force provision body 71 and support body 11 may be adjusted to prevent wrinkles from being formed on the laundry, irrespective of the size of the laundry.

Laundry treatment apparatus 100 with the above-stated construction is operated as follows.

First, a user hangs laundry on laundry treatment apparatus 100 in the state shown in FIG. 3. That is, the user locates the laundry on laundry treatment apparatus 100 such that the shoulder part of the laundry is supported by support body 11.

Subsequently, the user separates tensile force provision body 71 from support body 11, and locates tensile force provision body 71, which has been separated from support body 11, in an opening formed in the lower end of the laundry. When tensile force provision body 71 is located in the lower end of the laundry, the user fixes the laundry to tensile force provision body 71 using fixing part 73.

When air supply unit 3 is operated in the state shown in FIG. 5, air is introduced into an air flow channel 111 defined in support body 11 through first filter 16.

Some of the air introduced into air flow channel 111 is discharged to body part B of the laundry through first discharge port 13, and the remainder of the air introduced into air flow channel 111 is discharged to sleeves S of the laundry through second filter 17 and third filter 18.

At least some of the air introduced into body part B of the laundry through first discharge port 13 flows back toward air supply unit 3 due to tensile force provision body 71. In a case in which a predetermined amount of air is captured in body part B of the laundry, tensile force is generated in body part B of the laundry, with the result that wrinkles may be removed from the laundry.

Additionally, in this embodiment, tensile force provision body 71 functions as a weight for straightening body part B of the laundry. When air is supplied into body part B of the laundry through air supply unit 3, the function of tensile force provision body 71 serving as the weight is enhanced, thereby more effectively removing wrinkles from the laundry.

Meanwhile, wrinkles formed on each sleeve S of the laundry may be removed by tensile force generated from the air supplied to each sleeve S of the laundry.

In this embodiment, a power supply unit 8 may supply electric power to air supply unit 3. The power supply unit may be provided outside support unit 1. Alternatively, the power supply unit may be provided inside support unit 1.

If power supply unit 8 is provided outside support unit 1, power supply unit 8 may include a power source provided outside support unit 1 and an electric power cable for connecting the motor (not shown) to the power source.

If power supply unit 8 is provided inside support unit 1, power supply unit 8 may be a battery separably disposed in support body 11 for supplying electric power to the motor. Alternatively, power supply unit 8 may include a rechargeable battery fixed in support body 11 for supplying electric power to the motor and an electric power cable separably disposed in support body 11 for connecting the rechargeable battery to a power source located outside support body 11 (such that electric power is supplied to the rechargeable battery through the electric power cable).

Figure 6:
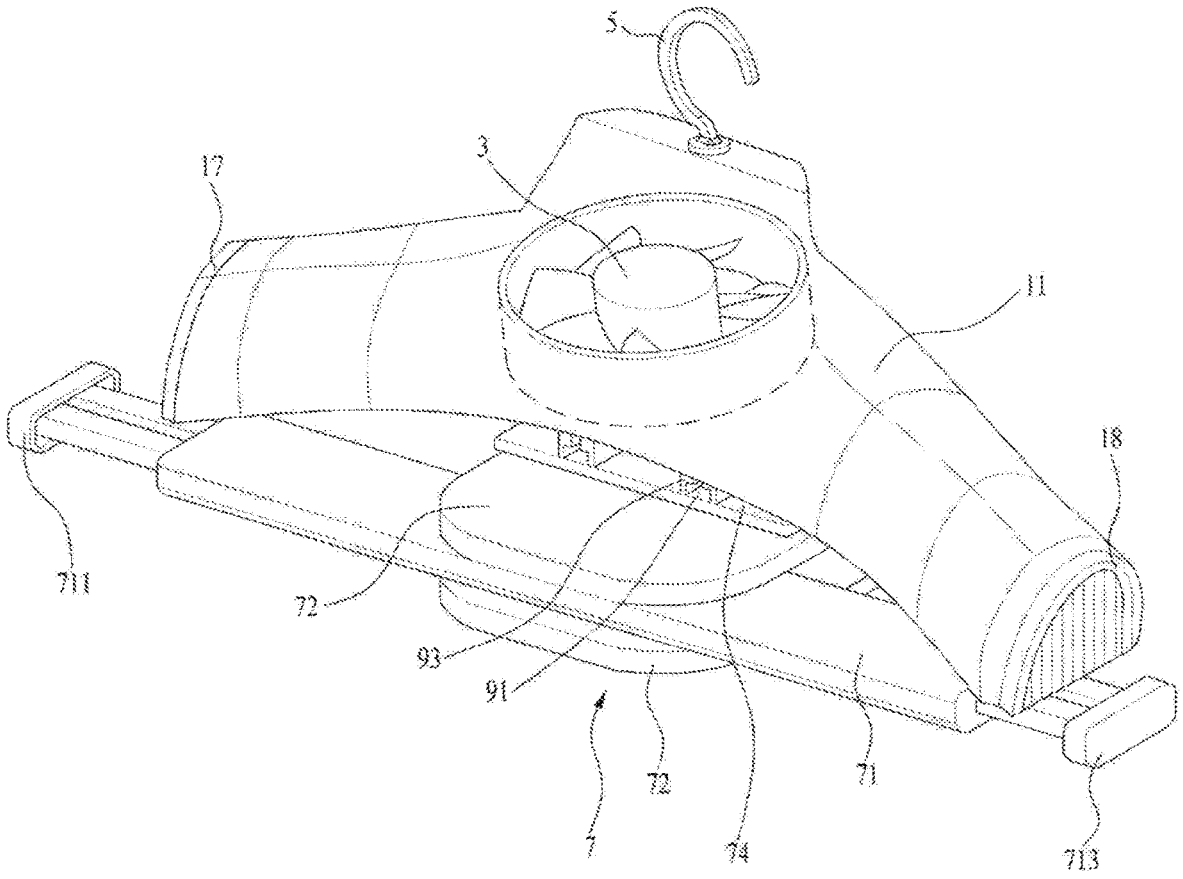
FIGS. 6 to 8 are views showing a laundry treatment apparatus according to another embodiment of the present invention.

FIG. 6 is a view showing a laundry treatment apparatus according to another embodiment of the present invention. Laundry treatment apparatus 100 according to this embodiment is characterized by further including a tensile force provision unit 7 separably fixed to laundry, which is different from the tensile force provision unit included in the laundry treatment apparatus shown in FIG. 3.

That is, laundry treatment apparatus 100 according to this embodiment may include a support unit 1 for supporting laundry, an air supply unit 3 provided in support unit 1 for supplying air into the laundry, a fastening unit 5 for separably fixing support unit 1 to an external structure, and a tensile force provision unit 7 separably mounted to support unit 1 such that tensile force provision unit 7 can be fixed to the laundry when tensile force provision unit 7 is separated from support unit 1.

Tensile force provision unit 7 may include a tensile force provision body 71 for separating the inner circumferential surface parts of the laundry from each other such that the inner circumferential surface parts of the laundry are spaced apart from each other by a predetermined distance, a tensile force provision body receiving part 72 separably mounted to support body 11, tensile force provision body receiving part 72 having a space defined therein for receiving tensile force provision body 71, and fixing parts 74 and 76 for fixing tensile force provision body receiving part 72 to the laundry.

Figure 7A:
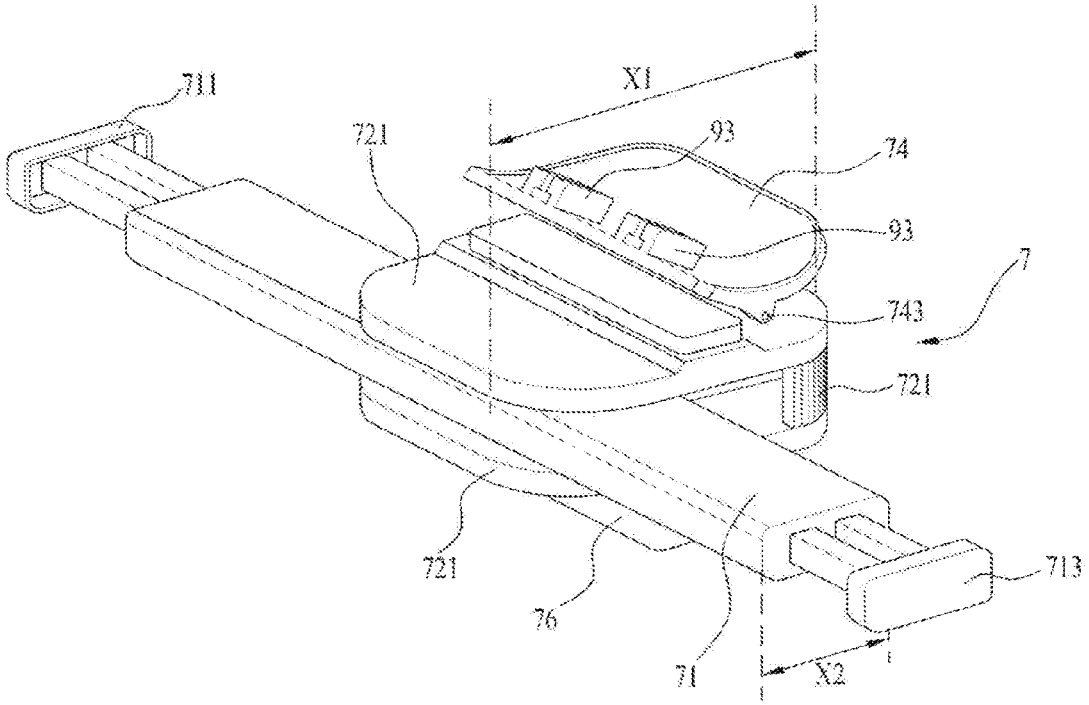
Figure 7B:
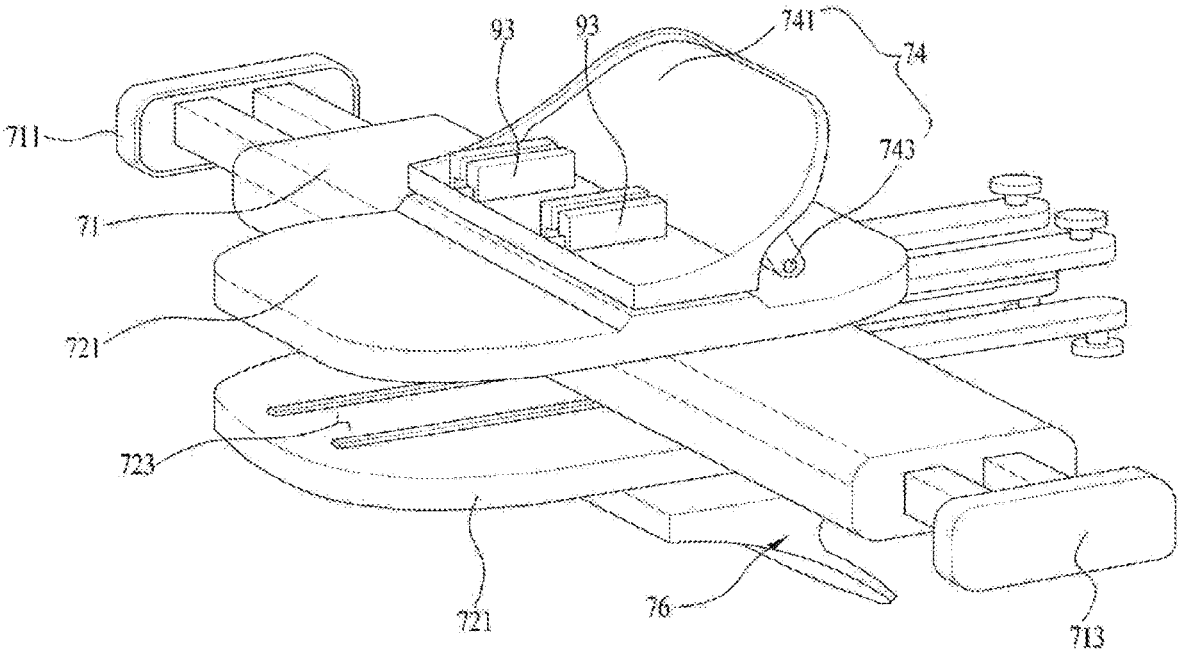

As shown in FIG. 7, tensile force provision body 71 is a bar type means for preventing the inner circumferential surface parts of the laundry from contacting each other. Tensile force provision body 71 may be provided with an extension part, which is configured to be withdrawn from tensile force provision body 71.

The extension part is a means for increasing the length of tensile force provision body 71 when the laundry is large, in which case it is not possible to prevent wrinkles from being formed on the laundry using only the original length of tensile force provision body 71.

The extension part may include a first extension member 711 and a second extension member 713 configured to be withdrawn from opposite ends of tensile force provision body 71. Alternatively, the extension part may be provided at only one end of tensile force provision body 71.

Tensile force provision body receiving part 72 may include a receiving part body 721 separably mounted to support body 11 and a receiving recess 723 provided in receiving part body 721 for receiving tensile force provision body 71.

In this case, receiving recess 723 may have a length X1 greater than the width X2 of tensile force provision body 71 such that the distance between tensile force provision body 71 and support body 11 can be adjusted.

The position of tensile force provision body 71 may be adjusted based on the shape or the length of the laundry in order to maximally prevent wrinkles from being formed on laundry having specific shapes or large lengths.

The fixing parts may include a first fixing member 74 provided at one surface of tensile force provision body receiving part 72 for fixing the laundry to tensile force provision body receiving part 72 and a second fixing member 76 provided at the other surface of tensile force provision body receiving part 72 for fixing the laundry to tensile force provision body receiving part 72.

First fixing member 74 and second fixing member 76 may have the same structure. First fixing member 74 may include a fixing plate 741 coupled to tensile force provision body receiving part 72 such that fixing plate 741 can be hinged about a shaft 743 and an elastic member (not shown) for pushing fixing plate 741 toward tensile force provision body receiving part 72.

In this embodiment, the attachment and detachment part may include a first attachment and detachment part 91 provided at one selected from between support body 11 and tensile force provision body receiving part 72 and a second attachment and detachment part 93 provided at the other selected from between support body 11 and tensile force provision body receiving part 72 such that second attachment and detachment part 93 is coupled to first attachment and detachment part 91.

Hereinafter, the operation of the laundry treatment apparatus according to this embodiment will be described.

First, a user hangs laundry on laundry treatment apparatus 100 in a state shown in FIG. 6. That is, the user locates the laundry on laundry treatment apparatus 100 such that the shoulder part of the laundry is supported by support body 11.

Subsequently, the user separates tensile force provision body receiving part 72 from support body 11, and locates tensile force provision body receiving part 72, separated from support body 11, in an opening formed in the lower end of the laundry.

Figure 8:
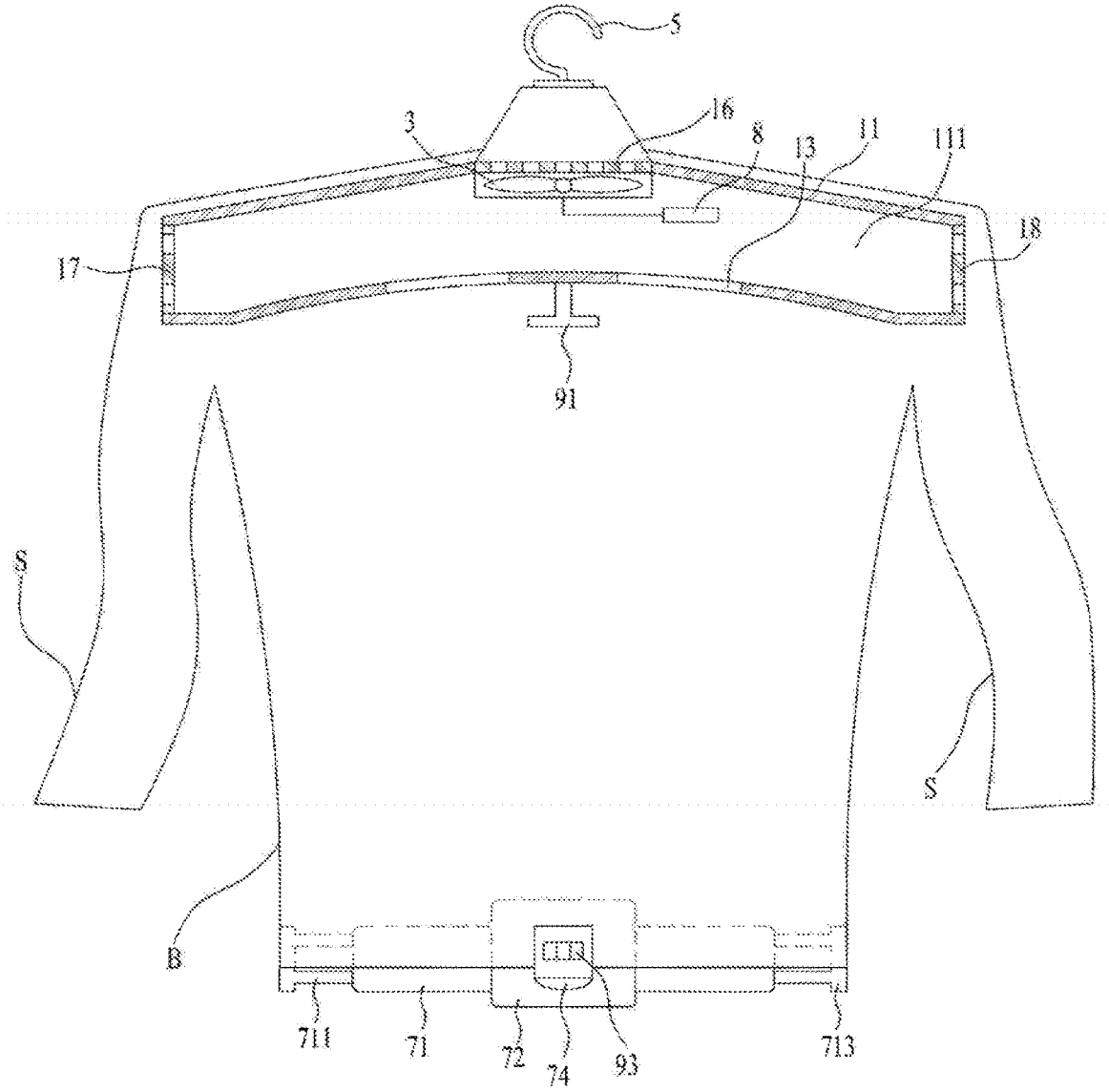

When tensile force provision body receiving part 72 is located in the lower end of the laundry as shown in FIG. 8, the user fixes the laundry to tensile force provision body receiving part 72 using first fixing member 74 and second fixing member 76.

After the laundry is fixed to tensile force provision body receiving part 72, the user adjusts the position of tensile force provision body 71, coupled in tensile force provision body receiving part 72, and then withdraws first extension member 711 and second extension member 713 from tensile force provision body 71 such that the inner circumferential surface parts of body part B of the laundry are spaced apart from each other by a predetermined distance.

When air supply unit 3 is operated in this state, air is introduced into air flow channel 111 through first filter 16.

Some of the air introduced into air flow channel 111 is discharged to body part B of the laundry through first discharge port 13, and the remainder of the air introduced into air flow channel 111 is discharged to sleeves S of the laundry through second filter 17 and third filter 18.

In this embodiment, tensile force provision unit 7 functions as a weight for straightening body part B of the laundry. When air is supplied into body part B of the laundry through air supply unit 3, therefore, wrinkles are removed from the laundry while moisture absorbed by the laundry is dried.

Furthermore, in this embodiment, tensile force provision body 71, tensile force provision body receiving part 72, and extension parts 711 and 713 may also function to capture a predetermined amount of air in body part B of the laundry, thereby more effectively removing wrinkles from the laundry.

Meanwhile, wrinkles formed on each sleeve S of the laundry may be removed by tensile force generated from the air supplied to each sleeve S of the laundry.

In this embodiment, power supply unit 8 may also supply electric power to air supply unit 3. The power supply unit may be provided outside support unit 1. Alternatively, the power supply unit may be provided inside support unit 1.

If power supply unit 8 is provided outside support unit 1, power supply unit 8 may include a power source provided outside support unit 1 and an electric power cable for connecting the motor (not shown) to the power source.

If power supply unit 8 is provided inside support unit 1, power supply unit 8 may be a battery separably disposed in support body 11 for supplying electric power to the motor. Alternatively, power supply unit 8 may include a rechargeable battery fixed in support body 11 for supplying electric power to the motor and an electric power cable separably disposed in the support body 11 for connecting the rechargeable battery to a power source located outside support body 11 (such that electric power is supplied to the rechargeable battery through the electric power cable).

Figure 9:
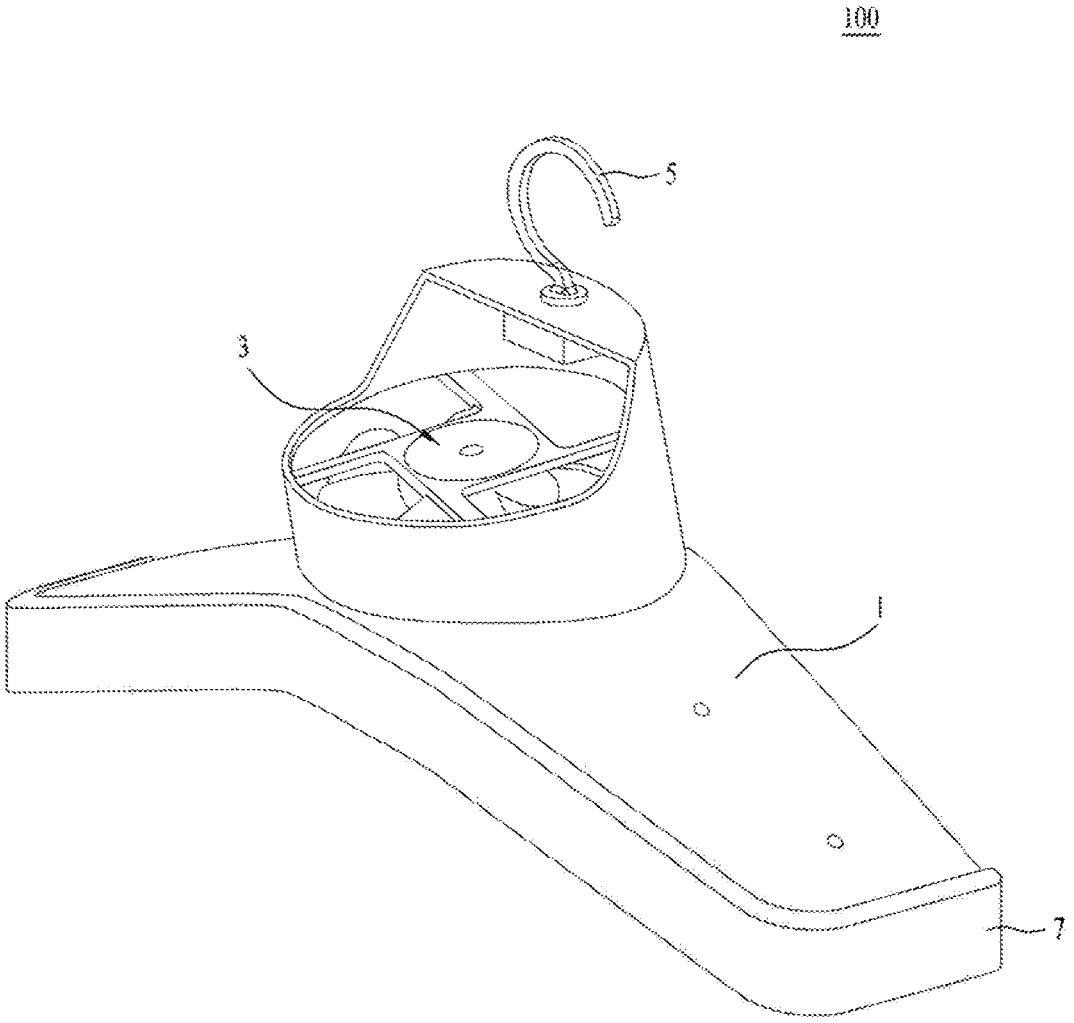
FIGS. 9 to 11 are views showing a laundry treatment apparatus according to a further embodiment of the present invention.

FIG. 9 is a view showing a laundry treatment apparatus according to a further embodiment of the present invention. Laundry treatment apparatus 100 according to this embodiment is characterized by further including a tensile force provision unit 7 configured such that the volume of tensile force provision unit 7 is increased when air is supplied, which is different from the tensile force provision unit included in the laundry treatment apparatus shown in FIG. 3.

That is, laundry treatment apparatus 100 according to this embodiment may include a support unit 1 for supporting laundry, a tensile force provision unit 7 disposed in the laundry, hung on support unit 1, such that the volume of tensile force provision unit 7 can increase, an air supply unit 3 provided in support unit 1 for supplying air to tensile force provision unit 7, and a fastening unit 5 for separably fixing support unit 1 to an external structure.

Figure 10:
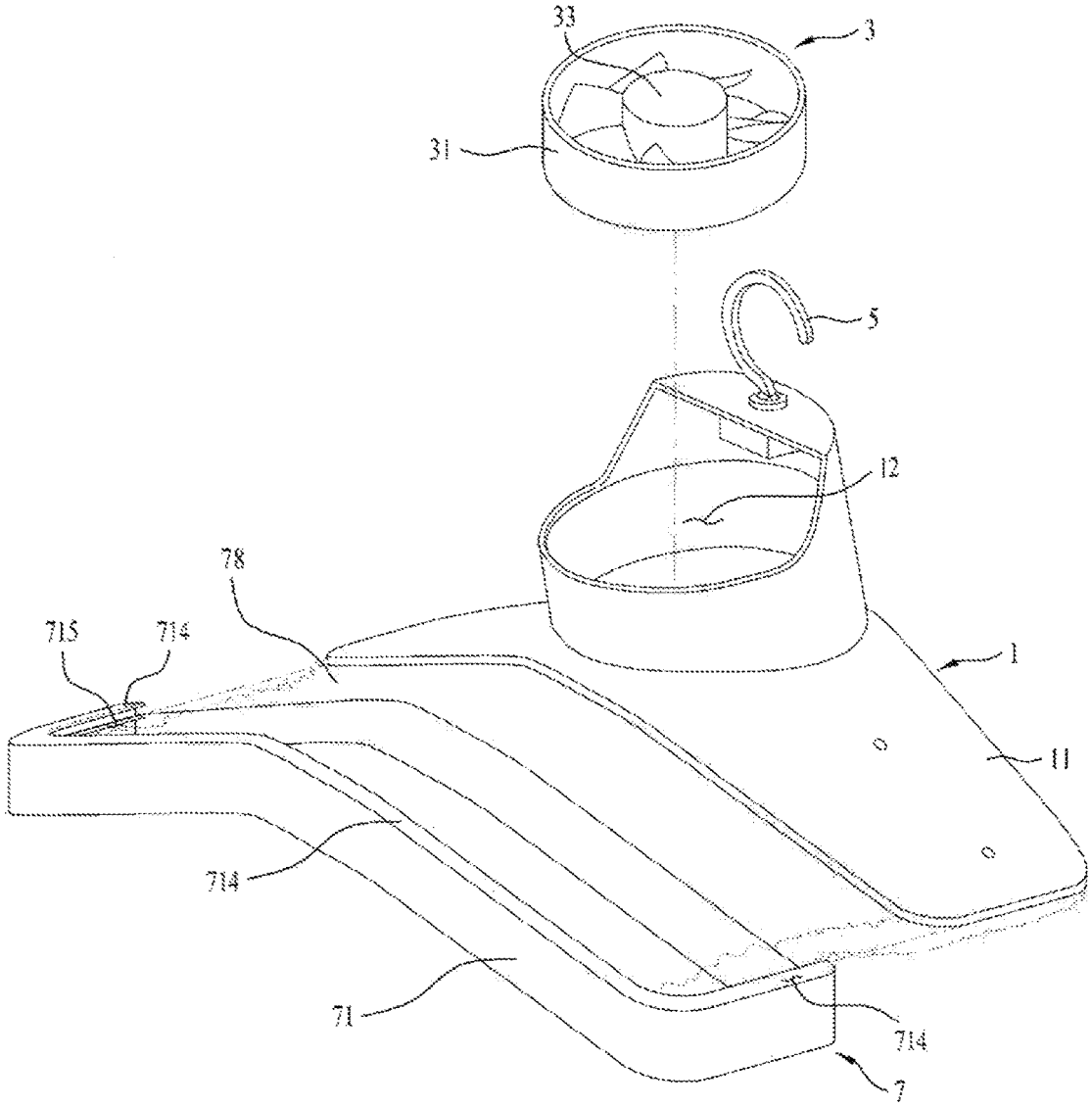

As shown in FIG. 10, support unit 1 may include a support body 11 for supporting laundry, fastening unit 5 being fixed to support body 11, and an inlet port 12 formed through support body 11.

The shape of support body 11 is not particularly restricted so long as support body 11 can support the laundry. FIG. 9 shows support body 11 being formed in the shape of a bar by way of example.

Air supply unit 3 may be provided in inlet port 12. Air supply unit 3 may include a housing 31 provided in inlet port 12, a fan 33 rotatably provided in housing 31, and a motor (not shown) for rotating fan 33.

Fastening unit 5 is a means for fixing support unit 1 to an external structure, such as a wardrobe or a wall. As shown, fastening unit 5 may be configured as a hook.

Tensile force provision unit 7 is a means fixed to support body 11 for generating tensile force on the surface of the laundry when air supply unit 3 is operated. Tensile force provision unit 7 may include a tensile force provision body 71 separably mounted to support body 11 and an expansion part 78 for connecting tensile force provision body 71 to support body 11, expansion part 78 being configured such that the volume of expansion part 78 is increased when air supply unit 3 is operated.

A receiving recess 715, in which expansion part 78 is received, is provided in tensile force provision body 71. Receiving recess 715 is a space for receiving expansion part 78 in a state in which no air is supplied to expansion part 78 with the result that the volume of expansion part 78 does not increase.

Tensile force provision body 71 is separably coupled to support body 11 via a coupling part 714. FIG. 10 shows coupling part 714 being formed as a flange configured to receive the outer circumferential surface of support body 11 by way of example.

In this case, a user may insert the outer circumferential surface of support body 11 into coupling part 714 such that tensile force provision body 71 is fixed to support body 11. When the user withdraws the outer circumferential surface of support body 11 from coupling part 714, tensile force provision body 71 may be separated from support body 11.

When tensile force provision body 71 is separated from support body 11, tensile force provision body 71 falls away from support body 11 due to gravity. As a result, expansion part 78, one end of which is fixed to support body 11, spreads.

FIG. 10 shows only an example of coupling part 714. The structure or shape of coupling part 714 is not particularly restricted so long as coupling part 714 can separably couple tensile force provision body 71 to support body 11.

Figure 11:
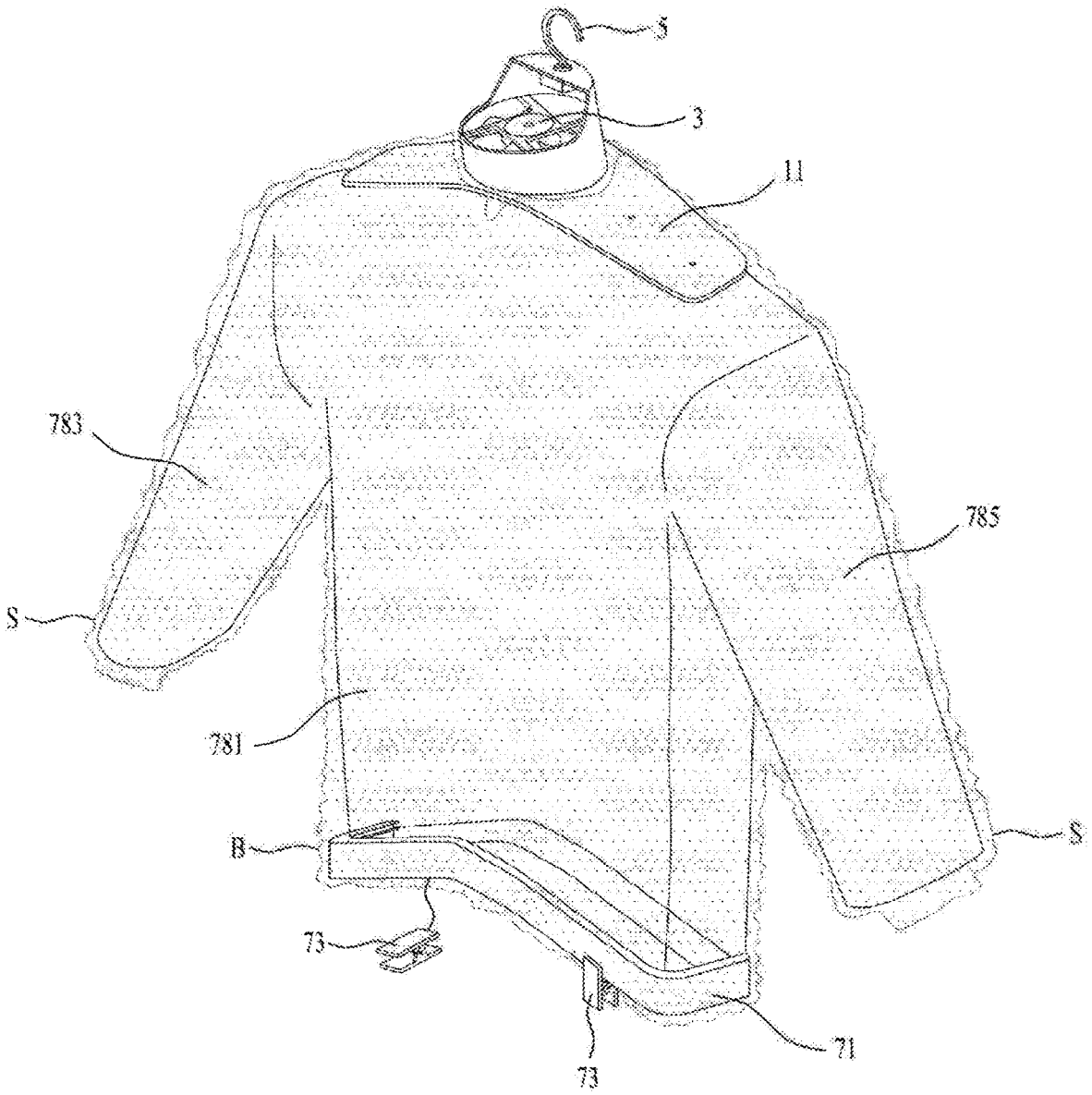

As shown in FIG. 11, expansion part 78 may include a first expansion body 781 provided to connect tensile force provision body 71 to support body 11, first expansion body 781 being configured such that air from air supply unit 3 is introduced into first expansion body 781 and a second expansion body 783 and a third expansion body 785 connected to first expansion body 781 such that the volumes of second expansion body 783 and third expansion body 785 arc increased by the air introduced into first expansion body 781.

First expansion body 781 is a means for providing tensile force to body part B of the laundry while the volume of first expansion body 781 is increased by the air supplied from air supply unit 3, and second expansion body 783 and third expansion body 785 are means for providing tensile force to the respective sleeves S of the laundry.

The volume of expansion part 78 remains increased due to the air supplied from air supply unit 3. To this end, expansion part 78 may have a closed space defined therein.

Expansion part 78 may be made of a material that prevents air inside expansion part 78 from being discharged outside expansion part 78 (e.g., vinyl). In this case, the air supplied into expansion part 78 may be discharged out of expansion part 78 through inlet port 12, which is formed in support body 11, when the operation of air supply unit 3 is stopped.

Alternatively, expansion part 78 may be made of a material that allows air inside expansion part 78 to be discharged outside expansion part 78 (e.g., cloth). In this case, the volume of expansion part 78 remains increased during the operation of air supply unit 3. When the operation of air supply unit 3 is stopped, however, the air inside expansion part 78 may be discharged out of expansion part 78 through inlet port 12 and the surface of expansion part 78.

In a case in which expansion part 78 is made of cloth, wrinkles may be removed from the laundry due to expansion part 78. In addition, in a case in which the laundry is wet, the laundry may also be dried.

Meanwhile, expansion part 78 may be made of two or more different materials. That is, expansion part 78 may be made of materials having different rates of expansion.

The material having a high rate of expansion may contact a portion of the laundry on which a large number of wrinkles are formed, and the material having a low rate of expansion may contact a portion of the laundry on which a small number of wrinkles are formed, thereby improving the efficiency of wrinkle removal.

For example, a large number of wrinkles are formed at the connections between body part B and respective sleeves S of the laundry. For this reason, the connection between second expansion body 783 and first expansion body 781 and the connection between third expansion body 785 and first expansion body 781 may be made of a material having a high rate of expansion.

If a portion of second expansion body 783 (e.g., the connection between second expansion body 783 and first expansion body 781) and a portion of third expansion body 785 (e.g., the connection between third expansion body 785 and first expansion body 781) are made of a material different from that of the remainder of the laundry, however, wrinkles may be formed at the boundaries of the laundry, at which different materials are connected to each other. For this reason, the entirety of second expansion body 783 and the entirety of third expansion body 785 may be made of a material having a higher rate of expansion than first expansion body 781.

Additionally, in this embodiment, tensile force provision unit 7 may further include a fixing part 73 for fixing the laundry to first expansion body 781 or tensile force provision body 71.

FIG. 11 shows an example in which fixing part 73 fixes the laundry to tensile force provision body 71. Fixing part 73 may be fixed to tensile force provision body 71 via a wire. Alternatively, fixing part 73 may be directly fixed to tensile force provision body 71.

Laundry treatment apparatus 100 with the above-stated construction is operated as follows.

In a state of laundry treatment apparatus 100 shown in FIG. 9, the user separates tensile force provision body 71 from support body 11.

When tensile force provision body 71 is separated from support body 11, tensile force provision body 71 falls away from support body 11. At this time, expansion part 78, received in receiving recess 715, spreads.

After the spreading of expansion part 78, the user hangs laundry on support body 11. That is, the user locates the laundry on support body 11 such that the shoulder part of the laundry is supported by support body 11. As a result, first expansion body 781 is located in body part B of the laundry.

After first expansion body 781 is located in body part B of the laundry, the user may connect fixing part 73 to the lower end of laundry so as to fix laundry to tensile force provision body 71.

Subsequently, the user locates second expansion body 783 and third expansion body 785 in respective sleeves S of the laundry, and then operates air supply unit 3.

As air supply unit 3 is operated, external air is supplied into first expansion body 781 through inlet port 12, and some of the air introduced into first expansion body 781 is supplied to second expansion body 783 and third expansion body 785.

When the supply of air into expansion part 78 is completed, as shown in FIG. 11, first expansion body 781 provides tensile force to body part B of the laundry, and second expansion body 783 and third expansion body 785 provide tensile force to respective sleeves S of the laundry.

While the volumes of the respective expansion bodies 781, 783, and 785 remain increased for a predetermined period of time, wrinkles are removed from the laundry due to tensile forces provided by the respective expansion bodies 781, 783, and 785. Consequently, laundry treatment apparatus 100 according to the present invention has the effect of drying wet laundry and removing wrinkles from the laundry. That is, laundry treatment apparatus 100 according to embodiments of the present invention has the effect of drying the laundry without wrinkles being formed on the laundry, making it possible to wear the laundry without first ironing it.

Meanwhile, laundry treatment apparatus 100 according to embodiments of the present invention may be used to remove wrinkles from laundry that is not wet (e.g., laundry that has been dried or laundry that has been worn at least once).

That is, laundry that has been dried or laundry that has been worn at least once may be hung on support body 11, water may be sprayed on the laundry using a sprayer, and air supply unit 3 may be operated, by which the same effect as that described above may be achieved.

When wrinkles have been completely removed from the laundry, the user separates the laundry from laundry treatment apparatus 100, and couples tensile force provision body 71 to support body 11 (the state shown in FIG. 1).

Meanwhile, a power supply unit (not shown) may supply electric power to air supply unit 3. The power supply unit may be provided outside support unit 1. Alternatively, the power supply unit may be provided inside support unit 1.

If the power supply unit is provided outside support unit 1, the power supply unit may include a power source provided outside support unit 1 and an electric power cable for connecting the motor (not shown) to the power source. If the power supply unit is provided inside support unit 1, the power supply unit may be configured as follows.

In an example, the power supply unit may be a battery separably disposed in support body 11 for supplying electric power to the motor. In another example, the power supply unit may include a rechargeable battery fixed in support body 11 for supplying electric power to the motor and an electric power cable separably disposed in support body 11 for connecting the rechargeable battery to a power source located outside support body 11 (such that electric power is supplied to the rechargeable battery through the electric power cable).

As is apparent from the above description, embodiments of the present invention have the effect of providing a laundry treatment apparatus that is capable of removing wrinkles from laundry after the laundry is washed, dried, or worn.

It will be apparent to those skilled in the art that various modifications and variations can be made without departing from the spirit or scope of the inventions. Thus, it is intended that the present disclosure covers the modifications and variations of this invention provided they come within the scope of the appended claims and their equivalents.

What is claimed is:

1. A laundry treatment apparatus comprising:

a support body for supporting laundry;

an air supply unit provided in the support body and configured for supplying air into laundry hung on the support body; and a tensile force provision unit separably mounted to the support body and configured for providing a tensile force to the laundry hung on the support body by using weight of the tensile force provision unit inside the laundry, wherein the tensile force provision unit comprises:

a tensile force provision body formed as a bar-shape parallel to the support body and located at a lower side of the support body, and configured to space apart the inner circumferential surface parts of the laundry from each other by a predetermined distance;

an extension part inserted into or withdrawn from at least one end of the tensile force provision body to adjust a length of the tensile force provision unit along a length direction perpendicular to a width direction and a height direction of the tensile force provision body;

a tensile force provision body receiving part that defines a receiving recess to accommodate the tensile force provision body and configured to separably connect to the support body; and a fixing part disposed on the tensile force provision body receiving part and configured to separably attach to the laundry for connecting the tensile force provision body receiving part to the laundry.

2. The laundry treatment apparatus of claim 1, wherein the tensile force provision unit enables at least some of the air supplied into the laundry to flow back toward the air supply unit.

3. The laundry treatment apparatus of claim 1, further comprising:

an attachment and detachment part for separably coupling the tensile force provision body to the support body.

4. The laundry treatment apparatus of claim 3, wherein the attachment and detachment part comprises:

a connection part provided at one selected from between the support body and the tensile force provision body receiving part; and a connection receiving part provided at the other selected from between the support body and the tensile force provision body receiving part, wherein the connection part is separably coupled to the connection receiving part for coupling the tensile force provision body to the support body.

5. The laundry treatment apparatus of claim 1, further comprising:

an inlet port provided in the support body such that the air supply unit is coupled to the inlet port;

a first discharge port provided in the support body for allowing air introduced through the inlet port to be discharged toward the tensile force provision body; and a second discharge port and a third discharge port provided in the support body for allowing the air introduced through the inlet port to be discharged toward respective sleeves of the laundry.

6. The laundry treatment apparatus of claim 5, further comprising:

a guide body located under the inlet port;

a through hole formed in the guide body for guiding the air introduced through the inlet port to the first discharge port;

a first inclined surface provided on the guide body for guiding the air introduced through the inlet port to the second discharge port; and a second inclined surface provided on the guide body for guiding the air introduced through the inlet port to the third discharge port.

7. The laundry treatment apparatus of claim 1, wherein the extension part extends and withdraws from the tensile force provision body.

8. The laundry treatment apparatus of claim 1, wherein the extension part comprises:

a first extension member provided in one end of the tensile force provision body; and a second extension member provided in the other end of the tensile force provision body, wherein each of the first extension member and the second extension member comprises:

an elongated member; and a head connected to one end of the elongated member, and configured to prevent insertion of the elongated member more than a predetermined length.

9. The laundry treatment apparatus of claim 8, further comprising:

a guided hole formed at the at least one end of the tensile force provision body along the length direction to insert one of the elongated members into the tensile force provision body through the guided hole.

10. The laundry treatment apparatus of claim 1, wherein a length of the receiving recess along a front-rear direction of the support body is greater than a width of the tensile force provision body.

11. The laundry treatment apparatus of claim 1, wherein the receiving recess partially separates a first half of the tensile force provision body receiving part and a second half of the tensile force provision body receiving part.

12. The laundry treatment apparatus of claim 11, wherein the fixing part includes a first fixing member and a second fixing member, and wherein each of the first fixing member and the second fixing member is coupled to each of the first half of the tensile force provision body receiving part and the second half of the tensile force provision body receiving part respectively.

13. The laundry treatment apparatus of claim 1, wherein the fixing part comprises:

a fixing plate elastically hinged about a shaft, and wherein the fixing plate fixes the laundry to the tensile force provision unit when the fixing plate is pushed towards the tensile force provision body receiving part.

14. The laundry treatment apparatus of claim 1, wherein the receiving recess is formed such that the tensile force provision body receiving part is 'C' shaped with an opening at a front direction of the support body when viewed along the width direction.

* * * * *